US008376186B2

(12) United States Patent
Wang

(10) Patent No.: US 8,376,186 B2
(45) Date of Patent: Feb. 19, 2013

(54) FLUID DISPENSER DEVICE

(75) Inventor: Teng-Huei Wang, Tainan County (TW)

(73) Assignee: Yonyu Plastics Co., Ltd., Tainan County (TW)

( * ) Notice: Subject to any disclaimer, the term of this patent is extended or adjusted under 35 U.S.C. 154(b) by 521 days.

(21) Appl. No.: 12/725,906

(22) Filed: Mar. 17, 2010

(65) Prior Publication Data

US 2011/0226810 A1 Sep. 22, 2011

(51) Int. Cl.
*B65D 35/22* (2006.01)

(52) U.S. Cl. ..... 222/94; 222/145.1; 222/521; 222/525; 222/532; 222/546; 222/549

(58) Field of Classification Search ..... 222/94–97, 222/129, 153.04, 153.13–153.14, 498–499, 222/502–503, 518–525, 531–532, 537, 544–553, 222/145.1, 145.6, 330–331, 482–485, 559, 222/562

See application file for complete search history.

(56) References Cited

U.S. PATENT DOCUMENTS 1,949,802 A * 3/1934 Lewis ..... 222/503
3,471,066 A * 10/1969 Micallef ..... 222/519
4,687,663 A * 8/1987 Schaeffer ..... 424/52
4,771,919 A * 9/1988 Ernst ..... 222/134
4,871,090 A * 10/1989 Hoffmann ..... 222/81
5,947,331 A * 9/1999 Goncalves ..... 222/39
6,267,273 B1 * 7/2001 Suzuki et al. ..... 222/505
6,347,726 B1 * 2/2002 Jackson et al. ..... 222/94
6,769,564 B2 * 8/2004 Prestele ..... 220/288
6,997,359 B2 * 2/2006 Boggs et al. ..... 222/520
2007/0175921 A1 * 8/2007 Keller ..... 222/137
2008/0314929 A1 * 12/2008 Keller ..... 222/145.6
2009/0173755 A1 * 7/2009 Ogawa et al. ..... 222/501

* cited by examiner

*Primary Examiner* — Kevin P Shaver
*Assistant Examiner* — Andrew P Bainbridge
(74) *Attorney, Agent, or Firm* — Ladas & Parry, LLP

(57) ABSTRACT

A fluid dispenser device has a container filled with two concentric squeezeable tubes that has two concentric threaded outlets. The two threaded outlets are secured to an internal cap that has fluid passages for both outlets and external threaded sections for engaging the inner shell and an outer shell. The internal cap also has two barrier members on its outer walls that engage with the inner shell's sliders that releasably engage the inner shell in its open or closed positions. The inner shell threadingly engages a conduit unit that when lowered closes the fluid passages with projecting stubs and when raised opens those passages to allow dispensation from the container. The external cap has internal splines that engages the internal cap's external grooves. When the external cap is removed, the internal cap is rotated which in turn rotates and raises the conduit unit which opens the valves. When the external cap is secured and rotated onto the internal cap's threads, the inner shell rotates which in turn lowers the conduit unit to close the valves.

10 Claims, 7 Drawing Sheets

FLUID DISPENSER DEVICE

BACKGROUND OF THE INVENTION

1. Field of the Invention

This invention relates to a fluid dispenser device, more particularly to a fluid dispenser device adapted for mounting at top open ends of coaxially extending inner and outer containers that contain two different fluids.

2. Description of the Related Art

A conventional multichamber fluid dispenser device includes two containers for separately accommodating two different fluids, such as household products, personal care products, etc. Each container has its own nozzle so that the fluids are dispensed simultaneously and are mixed together for use.

Referring to FIG. 1, a conventional multichamber fluid dispenser device 1 is shown to include two containers 100 disposed side-by-side within a deformable, collapsible barrel wall 11. By squeezing the barrel wall 11, fluids in the containers 100 can be squeezed simultaneously out of the containers 100. However, since the squeezing force applied to the barrel wall 11 by the user may not be uniform, the amounts of the fluids dispensed may not be in the right proportion. Moreover, no sealing means is provided to prevent prolonged exposure of the fluids in the containers to air.

SUMMARY OF THE INVENTION

An object of the present invention is to provide a fluid dispenser device which can be conveniently manipulated to dispense different fluids contained therein in a substantially fixed proportion and which can provide an effective seal for the fluids.

According to this invention, the fluid dispenser device includes an internal cap, a conduit unit, an inner shell, and a spline mechanism. The internal cap is adapted to cover top open ends of concentric inner and outer containers, and has first and second internal ports configured to be in fluid communication with the top open ends, respectively, and first and second valve seats disposed respectively on the first and second internal ports. The conduit unit is configured to be axially displaceable relative to the internal cap between a normal position and a raised position. The conduit unit includes a first conduit having a first outlet and a first communicating port which is in fluid communication with the first internal port through the first valve seat, a second conduit having a second outlet and a second communicating port which is in fluid communication with the second internal port through the second valve seat, a first valve disposed on the first communicating port, and a second valve disposed on the second communicating port. The inner shell includes an upper surrounding wall having an internally threaded segment in threaded engagement with the conduit unit to permit threaded movement of the inner shell relative to the conduit unit, and a lower surrounding wall configured to be retainingly slidable relative to the internal cap. The spline mechanism is disposed between the conduit unit and the internal cap. When the inner shell is turned for threaded movement relative to the conduit unit, the conduit unit is permitted to be displaced only axially between the normal and raised positions so as to move the first valve between a first engaging position, where the first valve is engaged with the first valve seat to thereby interrupt fluid communication between the first internal port and the first communicating port, and a first disengaging position, where the first valve is disengaged from the first valve seat to thereby permit the fluid communication between the first internal port and the first communicating port, and to move the second valve between a second engaging position, where the second valve is engaged with the second valve seat to thereby interrupt fluid communication between the second internal port and the second communicating port, and a second disengaging position, where the second valve is disengaged from the second valve seat to thereby permit the fluid communication between the second internal port and the second communicating port.

By virtue of the arrangement of the concentric inner and outer containers, fluids contained in the containers can be simultaneously and evenly dispensed when the outer container is squeezed or compressed. Moreover, when the conduit unit is in the normal position, the first and second valves are respectively engaged with the first and second valve seats so as to provide a good sealing effect for the fluids in the containers.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
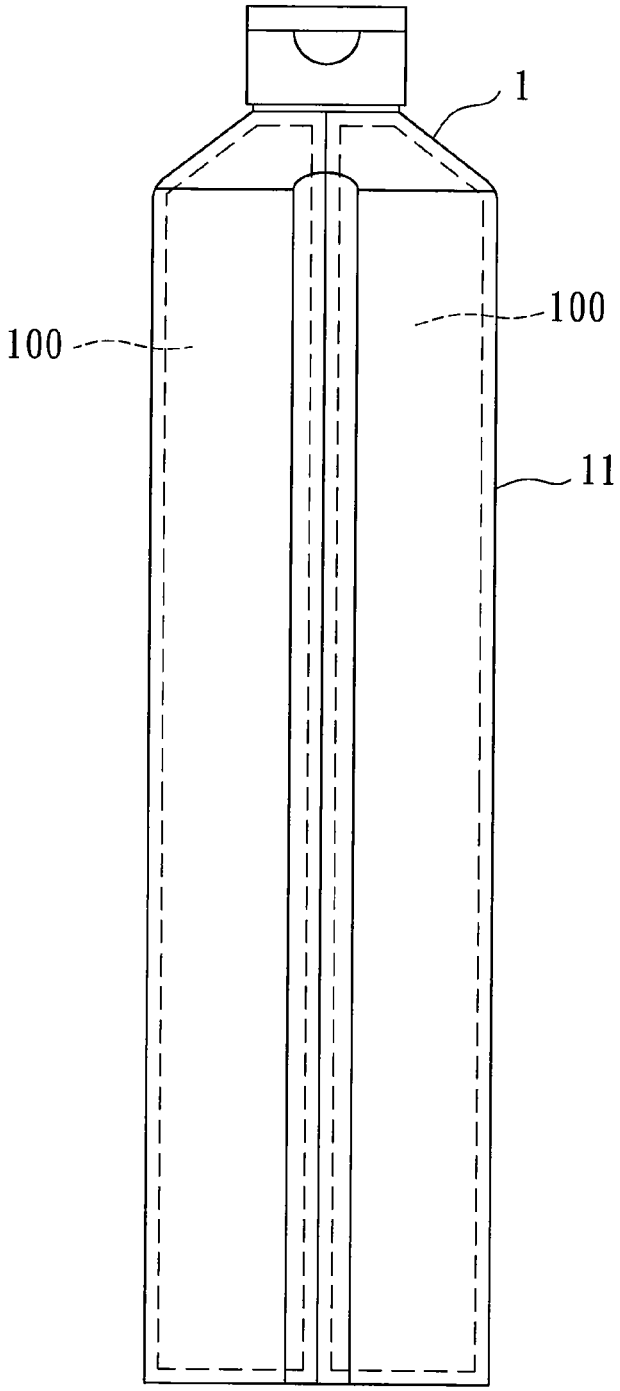
FIG. 1 PRIOR ART
FIG. 1 is a schematic view of a conventional multichamber fluid dispenser device.
Figure 2:
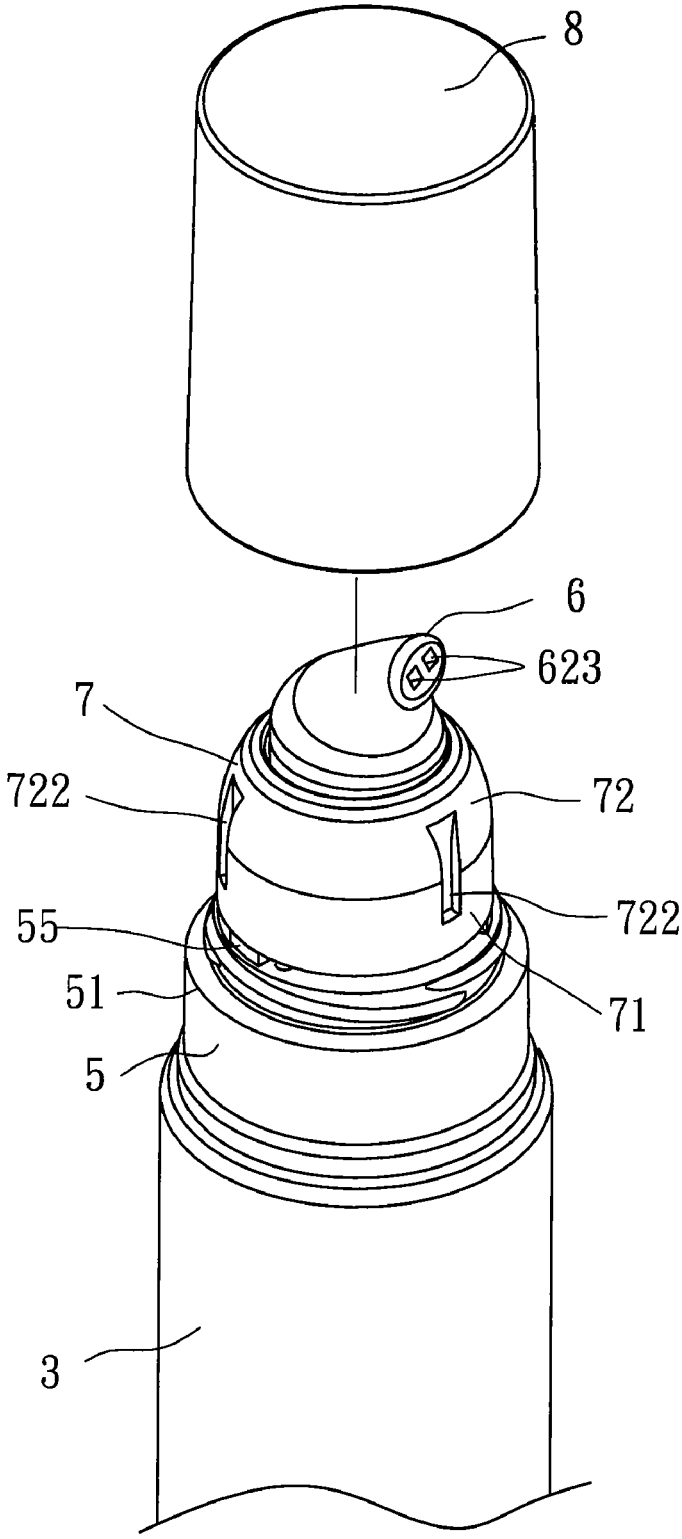
FIG. 2 is a fragmentary perspective view of the preferred embodiment of a multichamber fluid dispenser device according to this invention.
Figure 3:
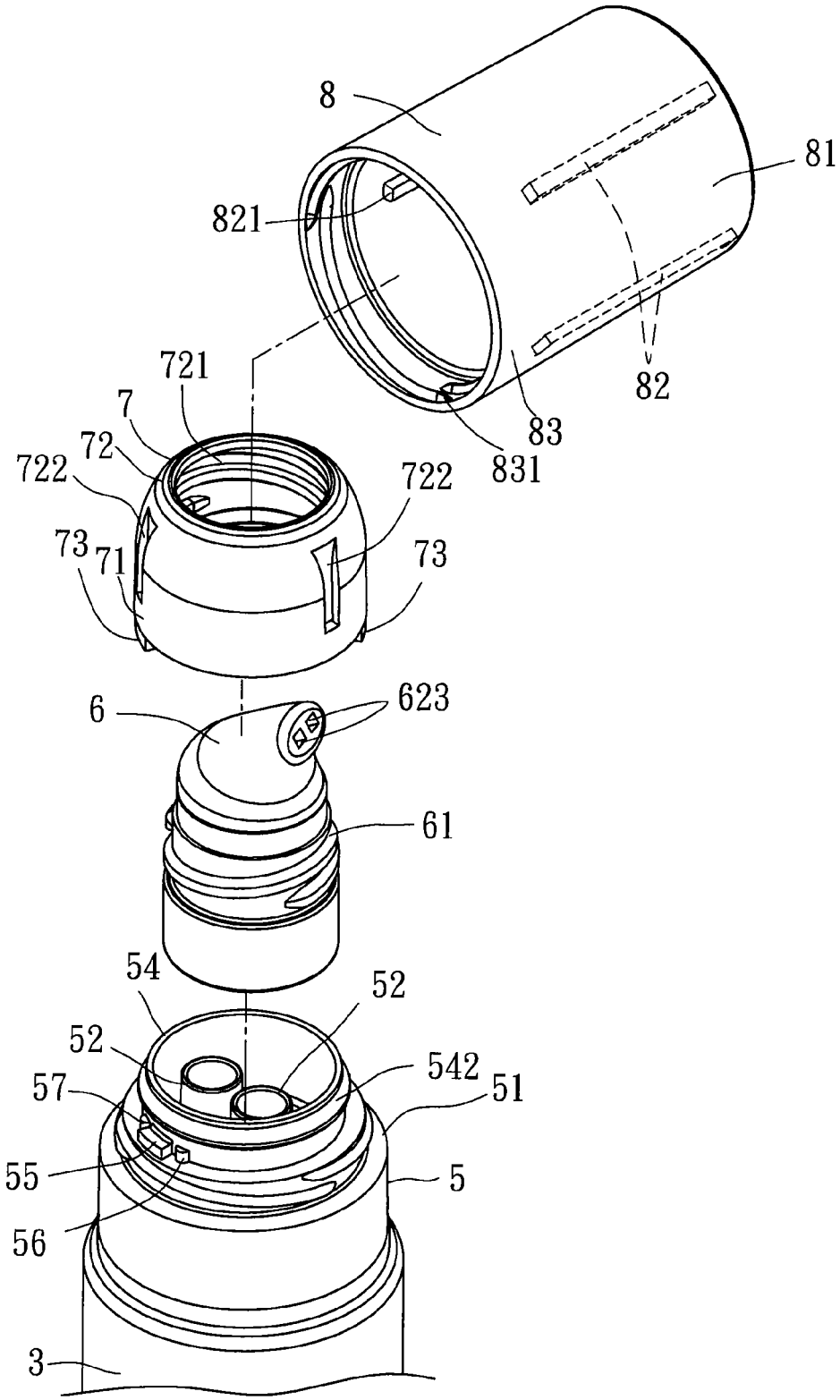
FIG. 3 is an exploded perspective view of the preferred embodiment.
Figure 4:
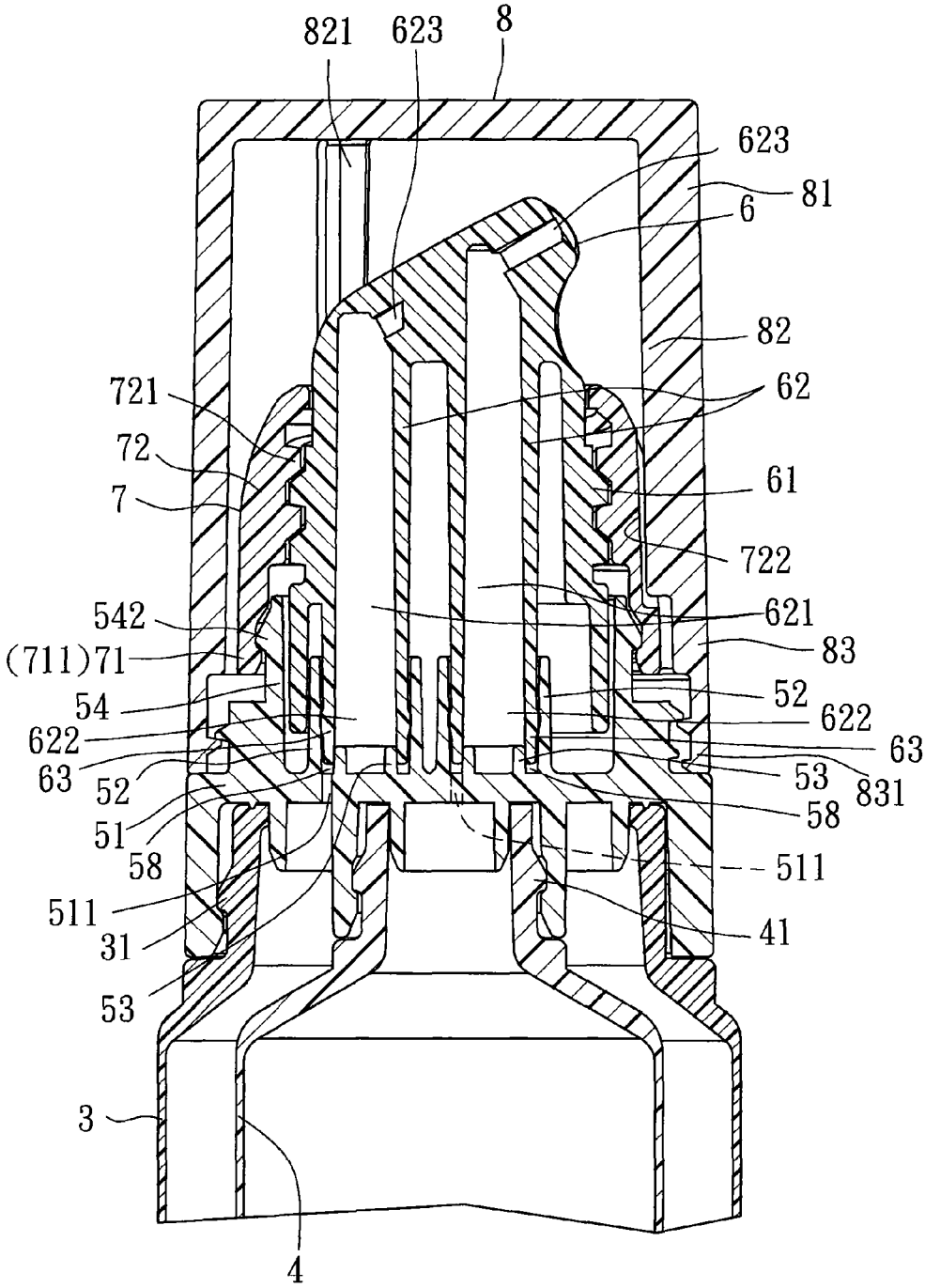
FIG. 4 is a fragmentary sectional view of the preferred embodiment in a closed non-dispensing state.

Referring to FIGS. 2 to 4, the preferred embodiment of a fluid dispenser device according to the present invention is adapted to be mounted at an inner top open end 41 of an inner container 4 and an outer top open end 31 of an outer container 3 that coaxially surrounds the inner container 4 along an axis. The inner and outer containers 4,3 are made of a suitable material that is capable of elastic deformation. As shown, the fluid dispenser device according to this invention comprises an internal cap 5, a conduit unit 6, an inner shell 7, and an outer shell 8.

Figure 5:
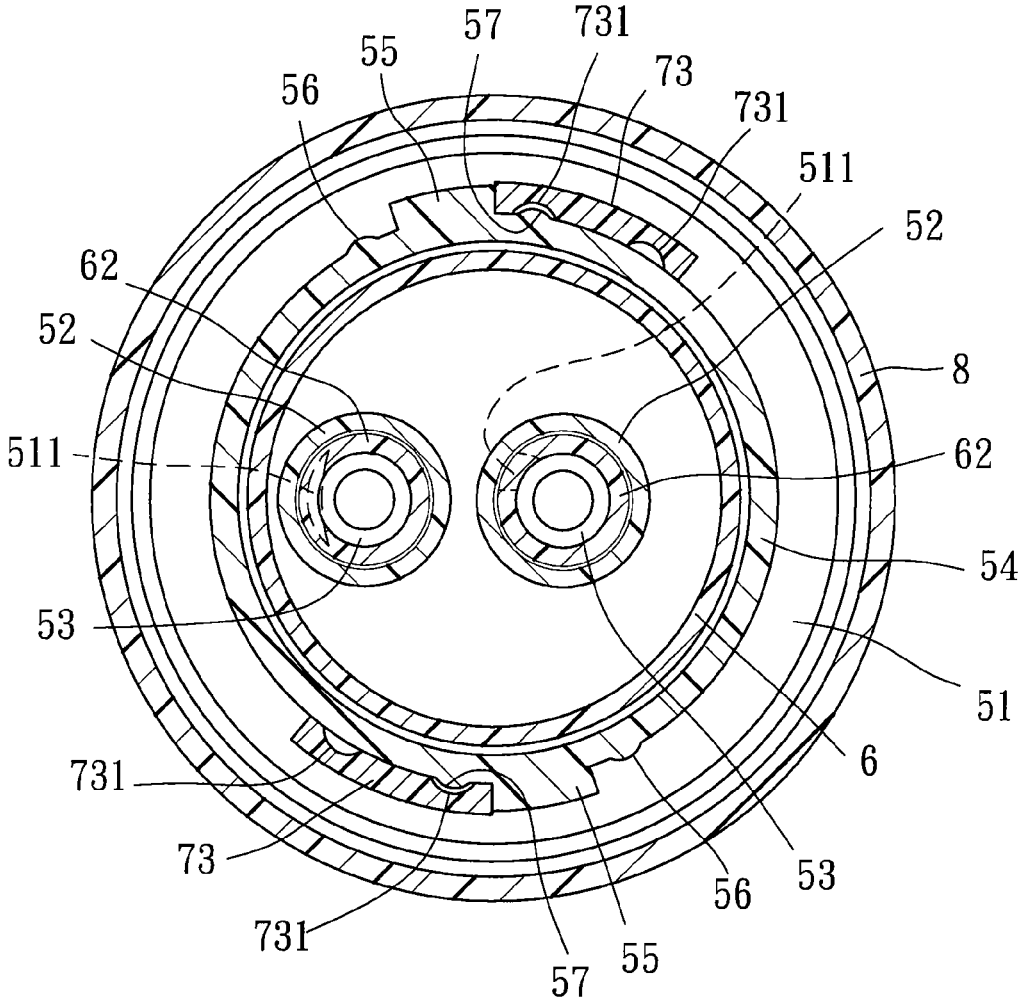
FIG. 5 is a cross-sectional view of the preferred embodiment in the closed non-dispensing state.

Referring to FIGS. 3 to 5, the internal cap 5 has a major wall 51 which is adapted to cover the inner and outer top open ends 41,31 of the inner and outer containers 4,3, and a peripheral wall 54 which surrounds the axis and which extends axially from the major wall 51 to terminate at a surrounding upper flange 542. The major wall 51 has first and second internal ports 511 which are configured to be in fluid communication with the top open ends, 41,31, respectively. First and second tubular walls 52 extend axially from the major wall 51, are offset from the axis, and respectively define first and second passages that are in fluid communication with the first and second internal ports 511, respectively. The internal cap 5 further has first and second tubular stubs 53 which are disposed on the major wall 51 and which are respectively surrounded by and spaced apart from the first and second tubular walls 52 by first and second surrounding clearances 58, respectively. The first and second surrounding clearances 58 are in fluid communication with the first and second internal ports 511, respectively. The first tubular wall 52 and the first tubular stub 53 are configured to serve as a first valve seat, and the second tubular wall 52 and the second tubular stub 53 are configured to serve as a second valve seat. In addition, the internal cap 5 has two barrier members 55 and two pairs of first and second resilient protrusions 56, 57 disposed on the peripheral wall 54. The first and second resilient protrusions 56,57 of each pair are disposed respectively at two sides of the respective barrier member 55.

The conduit unit 6 is configured to be axially displaceable relative to the internal cap 5 between a normal position and a raised position. The conduit unit 6 includes first and second conduit walls 62 which extend in an axial direction parallel to the axis and which respectively define first and second conduits 621 and which are configured to be kept in a fluid-tight and slidable engagement with the first and second tubular walls 52, respectively. Lower ends of the first and second conduit walls 62 are respectively formed as first and second valves 63, and are disposed to be respectively and fittingly received in the first and second surrounding clearances 58 when the conduit unit 6 is in the normal position, as shown in FIG. 4. Thus, the first and second tubular walls 52 and the first and second conduit walls 62 are configured to serve as a spline mechanism that limits displacement of the conduit unit 6 to only axial displacement between the normal and raised positions.

Further, the first conduit 621 has a first communicating port 622 disposed downstream of the first internal port 511 through the first clearance 58 of the first valve seat, and a first outlet 623 disposed downstream of the first communicating port 622. The second conduit 621 has a second communicating port 622 disposed downstream of the second internal port 511 through the second clearance 58 of the second valve seat, and a second outlet 623 disposed downstream of the second communicating port 622.

The inner shell 7 includes upper and lower surrounding walls 72,71 which are opposite to each other along the axis. The upper surrounding wall 72 has an internally threaded segment 721 which is in threaded engagement with an externally threaded segment 61 of the conduit unit 6 for threaded movement of the inner shell 7 relative to the conduit unit 6. The lower surrounding wall 71 has a surrounding lower flange 711 rotatably engaged with the upper flange 542 of the internal cap 5 to permit the inner shell 7 to be retainingly slidable relative to the internal cap 5 so as to prevent axial movement of the inner shell 7 when the inner shell 7 is threadedly moved relative to the conduit unit 6. The inner shell 7 further has two sliders 73 which are disposed on the lower surrounding wall 71 and which are slidable on the peripheral wall 54 of the internal cap 5. Each of the sliders 73 has two grooves 731 confronting the peripheral wall 54.

The outer shell 8 includes a lower skirt section 83 which has an internally threaded portion 831 configured to be threadedly engaged with the internal cap 5, and an upper operable section 81 which is turnable about the axis by a manual force, and which has a force transmitting region 82 that is coupled with the upper surrounding wall 72 of the inner shell 7 such that the inner shell 7 is dragged to move with the outer shell 8 to be threadedly moved relative to the conduit unit 6. In this embodiment, the force transmitting region 82 has three tongues 821 which are in splined engagement with three grooves 722 in the upper surrounding wall 72, respectively.

Figure 6:
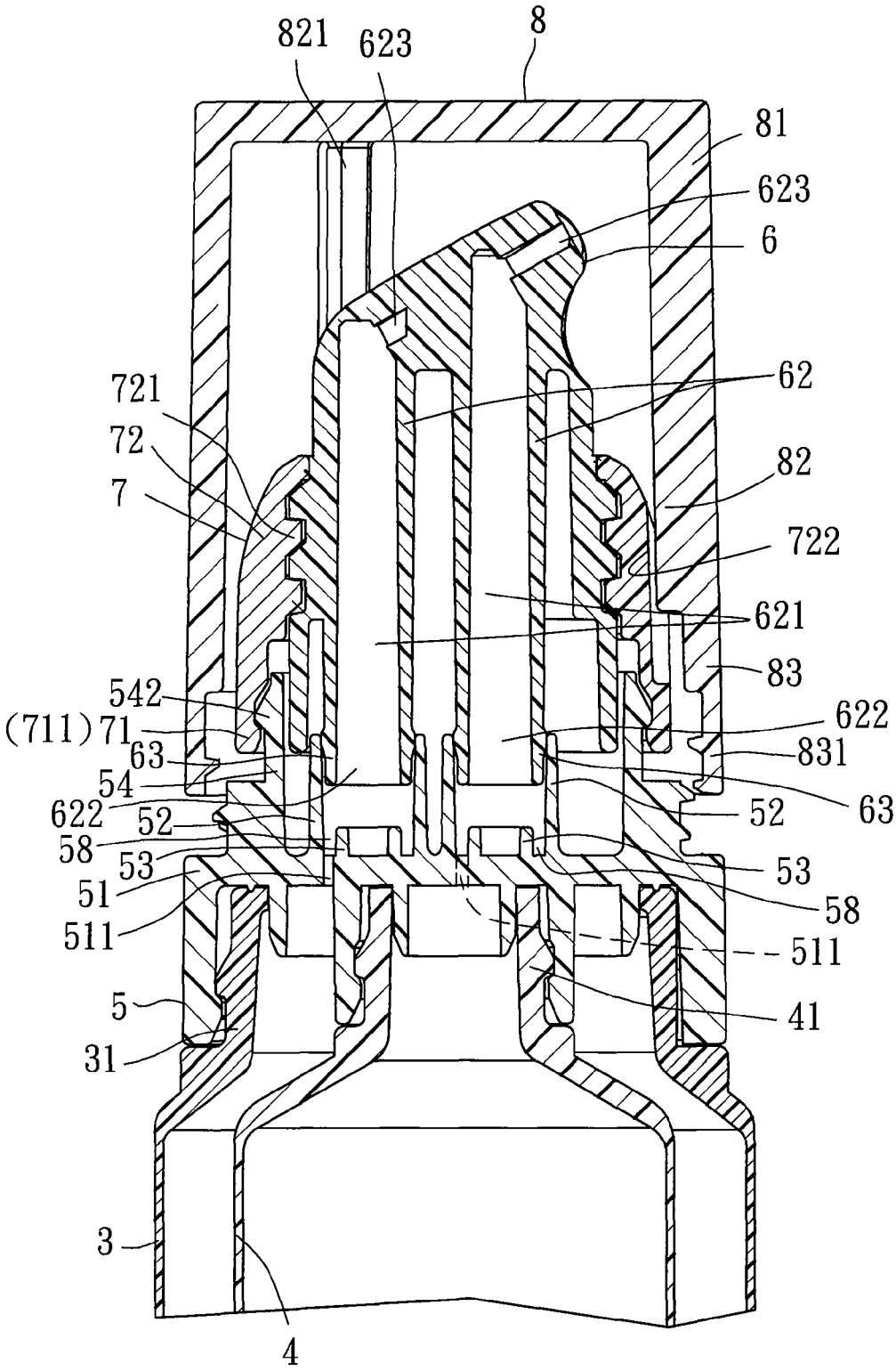
FIG. 6 is a fragmentary sectional view of the preferred embodiment in an open dispensing state.
Figure 7:
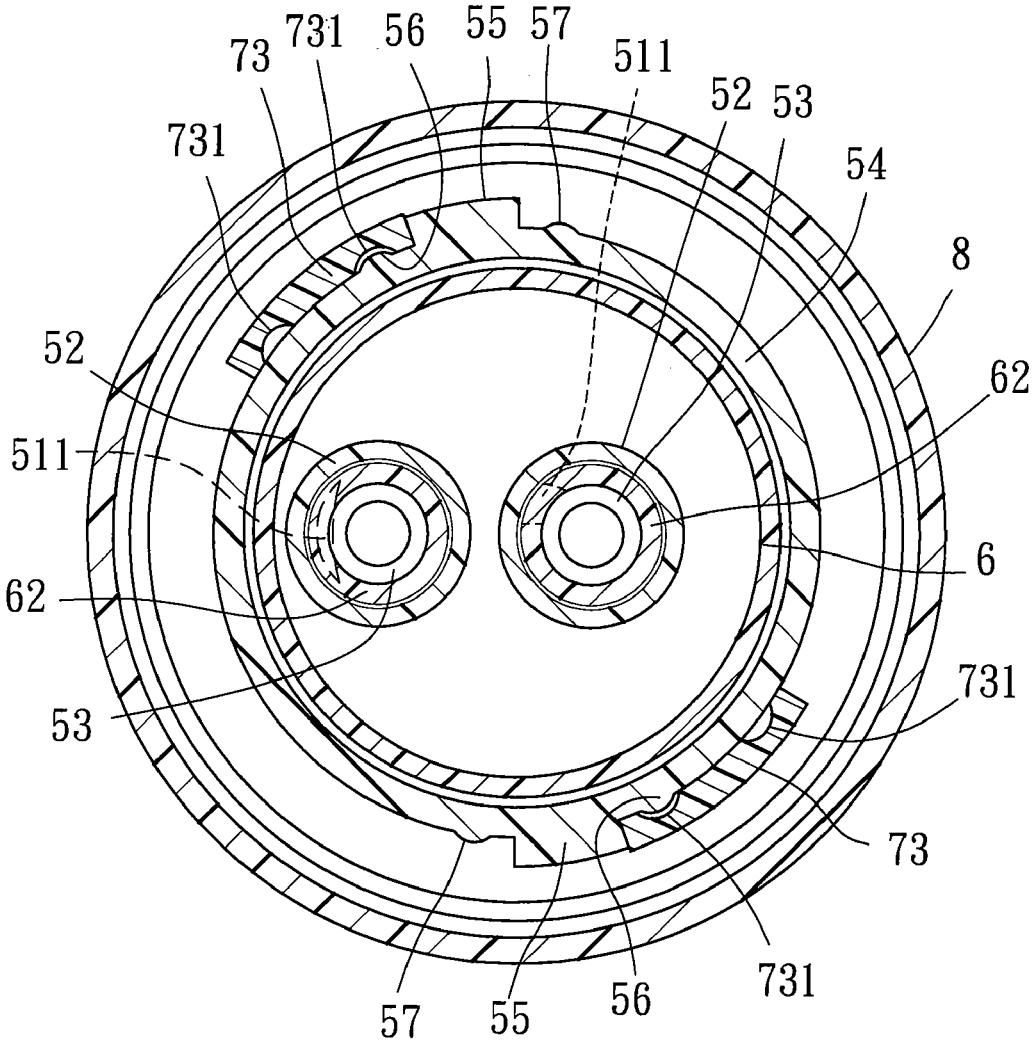
FIG. 7 is a cross-sectional view of the preferred embodiment in the open dispensing state.

Referring to FIGS. 3, 6 and 7, when it is desired to squeeze the fluids out of the inner and outer containers 4,3, the outer shell 8 is screwed-out relative to the internal cap 5 to rotate the inner shell 7 in a clockwise direction (see FIGS. 5 and 7), so that the conduit unit 6 is brought to displace axially from the normal position to the raised position. During this displacement, the first valve 63 is displaced from a first engaging position, where the first valve 63 is engaged with the first valve seat (at 58) (see FIG. 4) to thereby interrupt fluid communication between the first internal port 511 and the first communicating port 622, to a first disengaging position, where the first valve 63 is disengaged from the first valve seat (see FIG. 6) to thereby permit fluid communication between the first internal port 511 and the first communicating port 622, and the second valve 63 is displaced from a second engaging position, where the second valve 63 is engaged with the second valve seat (at 58) (see FIG. 4) to thereby interrupt fluid communication between the second internal port 511 and the second communicating port 622, to a second disengaging position, where the second valve 63 is disengaged from the second valve seat (see FIG. 6) to thereby permit fluid communication between the second internal port 511 and the second communicating port 622. In addition, with this displacement, as shown in FIGS. 5 and 7, the sliders 73 are blocked by the respective barrier members 55 from moving further in the clockwise direction, and each of the first resilient protrusions 56 is engaged in a corresponding one of the grooves 731 in the respective slider 73 to releasably retain the inner shell 7 relative to the internal cap 5 so as to position the conduit unit 6 in the raised position. Subsequently, the outer shell 8 is removed, and the outer container 3 can be squeezed or compressed to increase the internal pressure within the containers 4,3 so that the fluids can be squeezed out of the containers 4,3.

When it is desired to close the top open ends 41,31 of the containers 4,3, the outer shell 8 is mounted on the inner shell 7 to permit engagement of the tongues 821 with the grooves 722, respectively, and to permit threaded movement of the inner shell 7 relative to the conduit unit 6 such that the inner shell 7 is turned in a counterclockwise direction to bring the conduit unit 6 into axial displacement from the raised position to the normal position. Hence, the first and second valves 63 are moved to the first and second engaging positions, respectively. Meanwhile, the sliders 73 are respectively blocked by the barrier members 55 from moving further in the counterclockwise direction, and the resilient protrusions 57 are engaged in the grooves 731 of the respective sliders 73.

It is noted that, although the outer shell 8 in this embodiment is provided to be threadedly engaged with the internal cap 5 and to be in splined engagement with the inner shell 7 so as to enable the inner shell 7 to be threadedly moved therewith relative to the conduit unit 6, the inner shell 7 may be configured to be manually operable to rotate about the axis so as to result in axial displacement of the conduit unit 6. In addition, although the first and second resilient protrusions 56,57 in this embodiment are provided to respectively engage the grooves 731 formed in the sliders 73, they may be disposed on the sliders 73 to engage grooves formed in the peripheral wall 54 of the internal cap 5. Moreover, the rotation of the inner shell 7 may be stopped through engagement of the first and second resilient protrusions 56,57 with the respective grooves 731 instead of through the barrier members 55.

As illustrated, by virtue of the arrangement of the concentric inner and outer containers 4,3, the fluids within the containers 4,3 can be simultaneously dispensed when the outer container 3 is squeezed or compressed, and the squeezing force applied to the outer container 3 can be evenly transmitted to the inner container 4 so that amounts of the fluids dispensed are in a substantially fixed proportion. Moreover, since the conduit unit 6 is axially displaceable with movement of the outer shell 8 and the inner shell 7 between the normal position, where the conduit unit 6 is in a closed non-dispensing state, and the raised position, where the conduit unit 6 is in an open dispensing state, the fluid dispenser device of the present invention is convenient to use. Furthermore, since the first and second valves 63 are respectively engaged with the first and second valve seats when the conduit unit 6 is in the normal position, the fluids can be properly sealed within the containers 3,4.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A fluid dispenser device adapted for mounting at an inner top open end of an inner container and an outer top open end of an outer container that coaxially surrounds the inner container along an axis, said fluid dispenser device comprising:

an internal cap adapted to cover the inner and outer top open ends, and having first and second internal ports which are configured to be in fluid communication with the inner and outer top open ends, respectively, and first and second valve seats which are disposed respectively on said first and second internal ports;

a conduit unit which is configured to be axially displaceable relative to said internal cap between a normal position and a raised position, said conduit unit including a first conduit having a first communicating port which extends in an axial direction parallel to the axis, and which is disposed downstream of said first internal port such that said first valve seat permits fluid communication between said first internal port and said first conduit, and a first outlet which is disposed downstream of said first communicating port, a second conduit having a second communicating port which extends in the axial direction, and which is disposed downstream of said second internal port such that said second valve seat permits fluid communication between said second internal port and said second conduit, and a second outlet which is disposed downstream of said second communicating port, a first valve disposed on said first communicating port, and configured such that, when said conduit unit is displaced from the normal position to the raised position, said first valve is displaced from a first engaging position, where said first valve is engaged with said first valve seat to thereby interrupt fluid communication between said first internal port and said first communicating port, to a first disengaging position, where said first valve is disengaged from said first valve seat to thereby permit fluid communication between said first internal port and said first communicating port, and a second valve disposed on said second communicating port, and configured such that, when said conduit unit is displaced from the normal position to the raised position, said second valve is displaced from a second engaging position, where said second valve is engaged with said second valve seat to thereby interrupt fluid communication between said second internal port and said second communicating port, to a second disengaging position, where said second valve is disengaged from said second valve seat to thereby permit fluid communication between said second internal port and said second communicating port;

an inner shell including upper and lower surrounding walls which are opposite to each other along the axis, said upper surrounding wall having an internally threaded segment which is in threaded engagement with said conduit unit to permit threaded movement of said inner shell relative to said conduit unit, said lower surrounding wall being configured to be retainingly slidable relative to said internal cap; and a spline mechanism disposed between said conduit unit and said internal cap such that, when said inner shell is turned about the axis for threaded movement relative to said conduit unit, said conduit unit is permitted to be displaced only axially between the normal and raised positions so as to move each of said first and second valves between a respective one of the first and second engaging positions and a respective one of the first and second disengaging positions.

2. The fluid dispenser device according to claim 1, wherein said internal cap has a major wall which is adapted to cover the inner and outer top open ends and which defines said first and second internal ports, and a peripheral wall which surrounds the axis and which extends axially from said major wall to terminate at an upper flange, said inner shell having a lower flange which is rotatably engaged with said upper flange so as to prevent axial movement of said inner shell when said inner shell is threadedly moved relative to said conduit unit.

3. The fluid dispenser device according to claim 2, wherein said spline mechanism includes first and second tubular walls which extend axially from said major wall, which are offset from the axis, and which respectively define first and second passages that are in fluid communication with said first and second internal ports respectively, and first and second conduit walls which respectively define said first and second communicating ports, and which are configured to be kept in a fluid-tight and slidable engagement with said first and second tubular walls, respectively, during the displacement of said conduit unit between the normal and raised positions.

4. The fluid dispenser device according to claim 3, wherein said internal cap includes first and second tubular stubs which are disposed on said major wall, and which are respectively surrounded by and spaced apart from said first and second tubular walls by first and second surrounding clearances, respectively, said first and second surrounding clearances being configured to permit said first and second conduit walls to be fittingly received therein when said conduit unit is displaced to the normal position.

5. The fluid dispenser device according to claim 4, wherein said first and second internal ports are disposed to be in fluid communication with said first and second surrounding clearances, respectively, said first tubular wall and said first tubular stub being configured to serve as said first valve seat, said second tubular wall and said second tubular stub being configured to serve as said second valve seat.

6. The fluid dispenser device according to claim 5, wherein said first and second valves are respectively disposed on lower ends of said first and second conduit walls so as to engage said first and second valve seats, respectively, when said first and second conduit walls are brought to be respectively engaged in said first and second clearances.

7. The fluid dispenser device according to claim 2, wherein said inner shell has a slider which is disposed on said lower surrounding wall and which is slidable on said peripheral wall of said internal cap, said internal cap having a barrier member which is disposed on said peripheral wall such that, when said inner shell is turned to move said conduit unit from the normal position to the raised position, said slider is blocked by said barrier member.

8. The fluid dispenser device according to claim 7, wherein said internal cap has first and second resilient protrusions which are disposed on said peripheral wall adjacent to said barrier member, said slider having at least one groove which is disposed to engage one of said first and second resilient protrusions to releasably retain said inner shell relative to said internal cap when said conduit unit is in one of the normal and raised positions.

9. The fluid dispenser device according to claim 1, further comprising an outer shell including a lower skirt section which has an internally threaded portion configured to be threadedly engaged with said internal cap, and an upper operable section that is turnable about the axis by a manual force, and that has a force transmitting region coupled with said upper surrounding wall of said inner shell such that said inner shell is dragged to move with said outer shell to be threadedly moved relative to said conduit unit.

10. The fluid dispenser device according to claim 9, wherein said force transmitting region is in splined engagement with said upper surrounding wall of said inner shell.

* * * * *